US008910610B2

(12) United States Patent
Thayer

(10) Patent No.: US 8,910,610 B2
(45) Date of Patent: Dec. 16, 2014

(54) OIL PUMP WITH DUAL SCAVENGING FOR A TWIN CAM ENGINE

(75) Inventor: Daniel Charles Thayer, Corfu, NY (US)

(73) Assignee: Daniel C. Thayer, Corfu, NY (US)

( * ) Notice: Subject to any disclaimer, the term of this patent is extended or adjusted under 35 U.S.C. 154(b) by 576 days.

(21) Appl. No.: 13/020,331

(22) Filed: Feb. 3, 2011

(65) Prior Publication Data

US 2011/0189042 A1 Aug. 4, 2011

Related U.S. Application Data

(60) Provisional application No. 61/301,196, filed on Feb. 3, 2010.

(51) Int. Cl.
*F01M 1/04* (2006.01)
*F01C 1/00* (2006.01)

(52) U.S. Cl.
CPC ..... *F01C 1/00* (2013.01)
USPC ..... 123/196 CP; 123/196 R; 123/198 C; 184/1.5; 184/6.5; 184/27.2

(58) Field of Classification Search
CPC ..... F01M 1/02; F01M 11/045; F01M 11/048; F01M 11/02; F01M 11/04; F01M 2001/123; F01M 2001/126
USPC ..... 418/61.3; 123/196 R, 196 CP, 198 C; 184/1.5, 6.5, 27.2
See application file for complete search history.

(56) References Cited

U.S. PATENT DOCUMENTS

| | | | | |
|---|---|---|---|---|
| 6,047,667 | A * | 4/2000 | Leppanen et al. | 123/196 R |
| 7,171,939 | B1 * | 2/2007 | Tiller | 123/196 R |
| 7,581,525 | B2 * | 9/2009 | Hanold et al. | 123/196 M |
| 8,011,333 | B2 * | 9/2011 | Burgess et al. | 123/54.4 |

* cited by examiner

*Primary Examiner* — Devon Kramer
*Assistant Examiner* — Patrick Hamo
(74) *Attorney, Agent, or Firm* — Joseph M. Noto; Bond Schoeneck & King PLLC

(57) ABSTRACT

The present invention is an oil pump used in combination with a twin cam type engine, such as a HARLEY DAVIDSON® type A or type B engine, that includes a first high pressure gerotor and cam chest scavenger gerotor housing, a separator plate that establishes an independent dual scavenging capability and a second crankcase sump scavenger gerotor housing that pulls oil from the crankcase sump. The oil pump also includes a high pressure gerotor that pulls oil from an oil reservoir and supplies oil under pressure through a stock or aftermarket cam plate to the engine, a cam chest scavenger gerotor to scavenge oil in a cam chest of the engine and return the oil to the oil reservoir, a crankcase sump scavenger gerotor to scavenge the oil in a crankcase sump of the engine and return the oil to the oil reservoir and an o-ring to prevent the oil from leaking into the cam chest of the engine.

12 Claims, 2 Drawing Sheets

OIL PUMP WITH DUAL SCAVENGING FOR A TWIN CAM ENGINE

This application claims priority to U.S. Provisional Application 61/301,196 filed on Feb. 3, 2010, the entire disclosure of which is incorporated by reference.

TECHNICAL FIELD & BACKGROUND

The present invention generally relates to an oil pump. More specifically, the invention is an oil pump with dual scavenging for a twin cam engine.

It is an object of the invention to provide an oil pump with dual scavenging for a twin cam engine, with more than one pump returning oil from a sump or oil gathering location to an oil storage area or an area away from the engine.

It is an object of the invention to provide an oil pump with dual scavenging for a twin cam engine, with a design that improves oil control within the engine, which improves engine performance by maintaining a dry sump.

It is an object of the invention to provide an oil pump with dual scavenging for a twin cam engine, with a separate oil passageway from the crankcase to a first suction pump and another separate passageway from the cam chest to a second suction pump.

What is really needed is an oil pump with dual scavenging for a twin cam engine, with more than one pump returning oil from a sump or oil gathering location to the oil storage area or an area away from the engine, with a design that improves oil control within the engine, which improves engine performance by maintaining a dry sump and a separate oil passageway from the crankcase to a first suction pump and another separate passageway from the cam chest to a second suction pump.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention, however, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1:
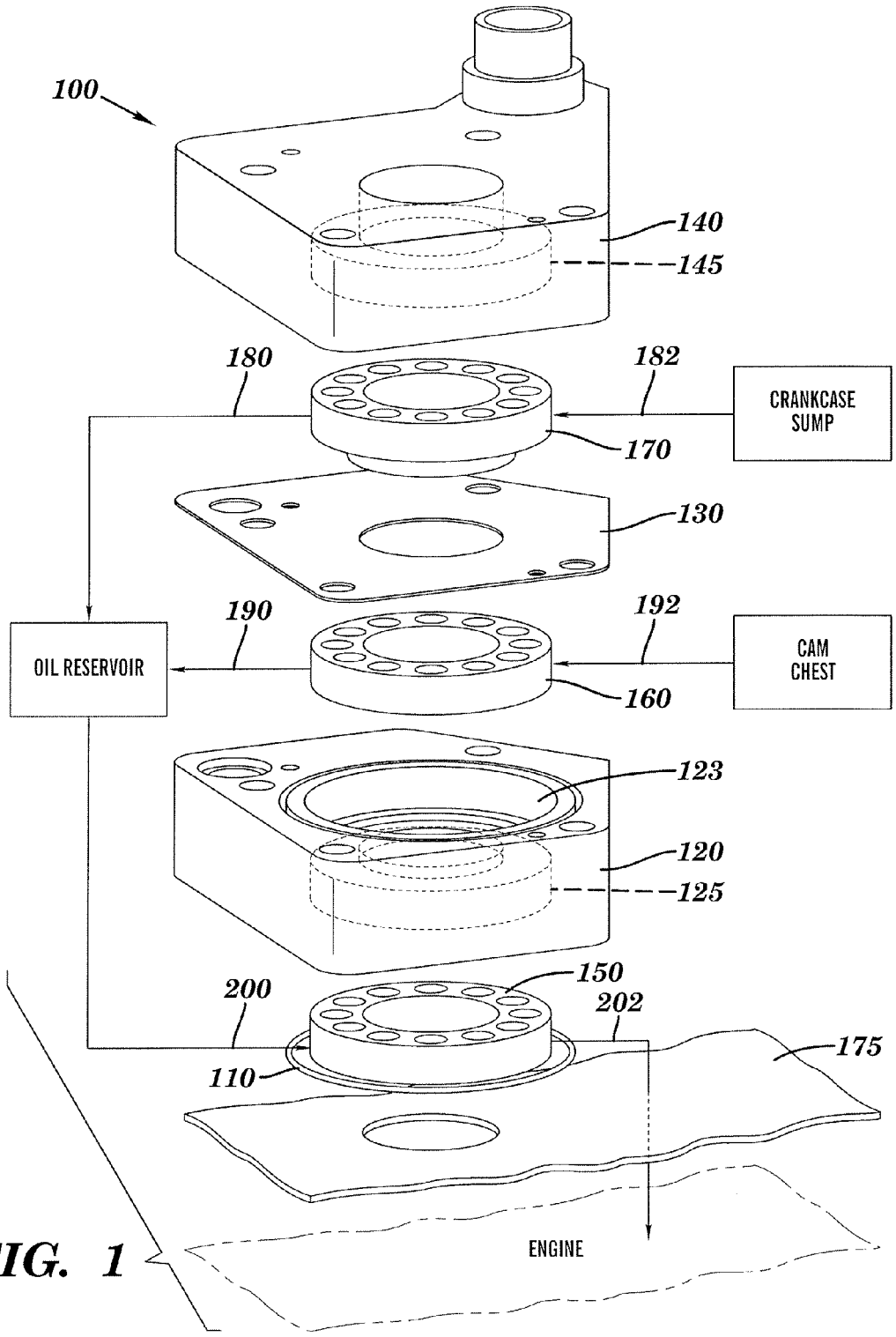
FIG. 1 illustrates an exploded side perspective view of an oil pump with a dual scavenging feature, in accordance with one embodiment of the present invention
Figure 2:
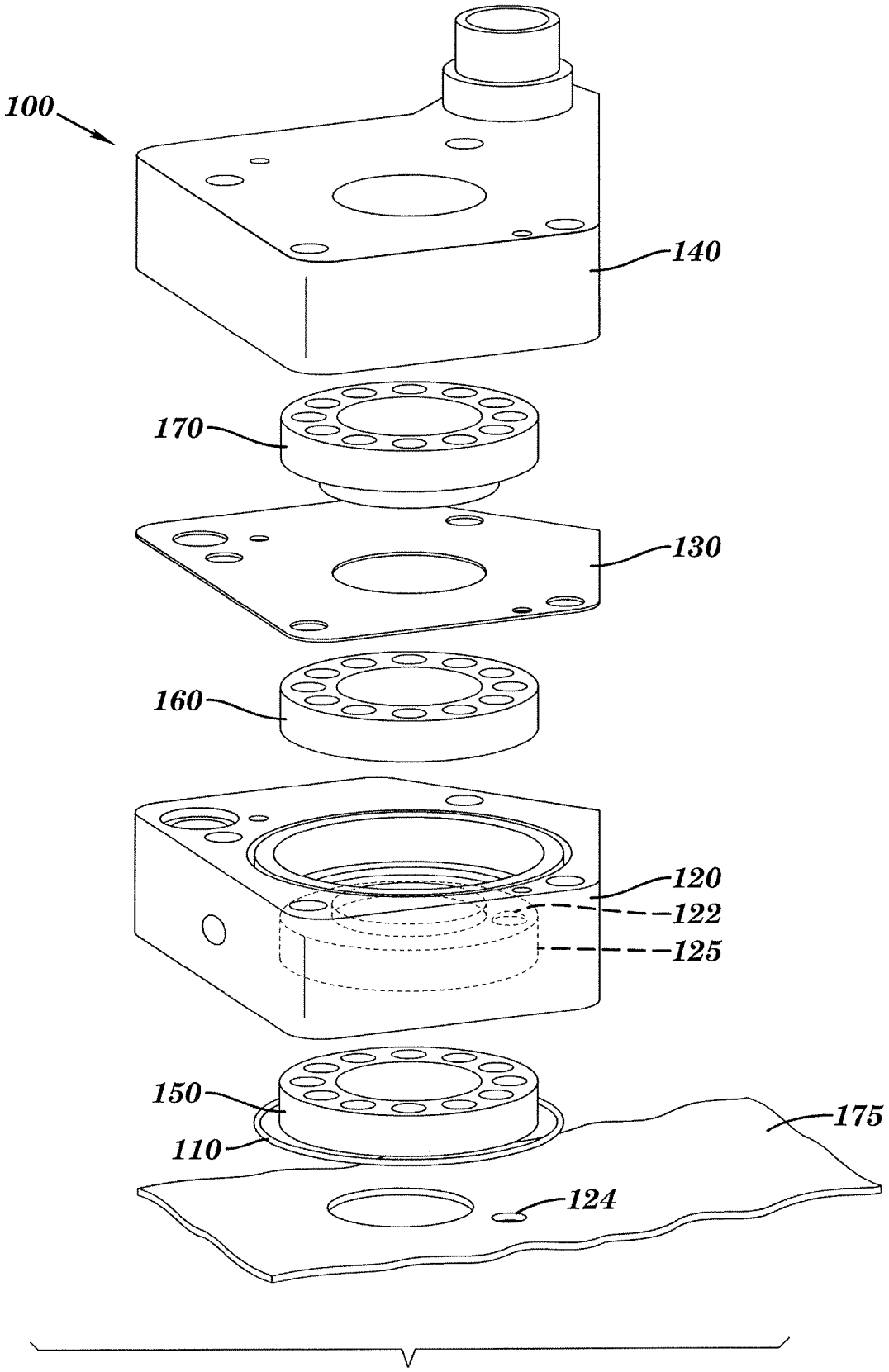
FIG. 2 illustrates and exploded side perspective view of an oil pump with a dual scavenging feature incorporating shadow porting, in accordance with an embodiment of the present invention.

FIG. 1 illustrates an exploded side perspective view of an oil pump with a dual scavenging feature 100, in accordance with one embodiment of the present invention. The oil pump with a dual scavenging feature 100 includes an o-ring 110, a high pressure gerotor and cam chest scavenger gerotor housing 120 having a top inset 123 and a bottom inset 125, a separator plate 130, a crankcase sump scavenger gerotor housing 140 having a bottom inset 145, a high pressure gerotor 150, a cam chest scavenger gerotor 160 and a crankcase sump scavenger gerotor 170.

The o-ring 110 provides a seal to prevent oil from leaking into the cam chest of the engine when under pressure. The separator plate 130 establishes the completely independent dual scavenging capability of the oil pump 100. Other known oil pump designs all share passageways to a single suction pump and do not provide optimal oil control in the engine. The oil pump with a dual scavenging feature 100 has three gerotors, a high pressure gerotor 150 for handling high pressure, a cam chest scavenger gerotor 160 for scavenging oil located in the cam chest through separate passageway 192, and a crankcase sump scavenger gerotor 170 for scavenging oil located in the crankcase sump through separate passageway 182. The high pressure gerotor 150 pulls oil from the oil reservoir through passageway 200 and supplies the oil under pressure through the stock or aftermarket cam plate 175 to the engine by passageway 202. Oil is returned to the crankcase sump and cam chest, which is then scavenged independently by the cam chest scavenger gerotor 160 and a crankcase sump scavenger gerotor 170 and is then returned to the oil reservoir through passageways 190 and 180, respectively.

The oil pump with a dual scavenging feature 100 is designed as a direct replacement for the stock and aftermarket oil pumps for the twin cam type A and type B HARLEY-DAVIDSON® engines and other similar twin cam type engines. The oil pump with a dual scavenging feature 100 attaches through any type of suitable fastener in the same manner as other stock and aftermarket oil pumps are attached to the cam plate of the engine. The oil pump with a dual scavenging feature 100 can be used in combination with a HARLEY-DAVIDSON® twin cam type A or type B engine, although other types of twin cam engines can be used in combination with the oil pump with a dual scavenging feature 100. The twin cam type A and type B engines are made by a number of different companies and have a similar oil system that benefits from the design of the oil pump with a dual scavenging feature 100 with dual scavenging pumps disposed in the single stock scavenge design (not shown). The oil pump with a dual scavenging feature 100 is designed to fit the stock and aftermarket cam plates that are designed for the twin cam type A and type B engines with no modifications being needed to the engines or cam plates.

Another feature of the oil pump with a dual scavenging feature 100 is employing the use of shadow ports 122 and porting. The shallow porting, on the opposite side of the high pressure gerotor 150 active porting 124, is recommended to help balance pressure axially across the gerotor 150 and reduce viscous losses. The shadow porting 122 implemented with the oil pump with a dual scavenging feature 100 will have the same porting radii and widths as the active ports 124. This is not possible with any other oil pump design because of the lack of adequate material thickness to machine the shadow port feature. The oil pump with a dual scavenging feature 100 also has a more robust billet aluminum body for better stability which also results in less chance for distortion.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

What is claimed is:

1. An oil pump, comprising:

a first housing comprising a top inset and a bottom inset;

a separator plate disposed above said first housing that enables an independent dual passageway scavenging capability of said oil pump;

a second housing comprising a bottom inset disposed above said separator plate;

a high pressure gerotor disposed below said first housing bottom inset that pulls oil from an oil reservoir through a first separate passageway and supplies the oil from the oil reservoir under pressure through a cam plate to an engine;

a cam chest scavenger gerotor disposed in said top inset of said first housing below said separator plate capable of independently scavenging oil in a cam chest sump of said engine through a second separate passageway and returning the oil from the cam chest sump to said oil reservoir;

a crankcase sump scavenger gerotor disposed in said second housing bottom inset above said separator plate capable of independently scavenging oil in said crankcase sump of said engine through a third separate passageway and returning the oil from the crankcase sump to said oil reservoir; and an o-ring disposed beneath said high pressure gerotor to prevent oil from leaking into said cam chest of said engine, wherein said cam chest scavenger gerotor is capable of independently providing a dry cam chest sump and said crankcase sump scavenger gerotor is capable of independently providing a dry crankcase sump.

2. The pump according to claim 1, wherein said first housing is a high pressure gerotor and cam chest scavenger gerotor housing.

3. The pump according to claim 1, wherein said second housing is a crankcase sump scavenger gerotor housing.

4. The pump according to claim 1, wherein said oil pump is designed as a replacement oil pump to the engine.

5. The pump according to claim 1, wherein said oil pump employs shadow ports and shadow porting.

6. The pump according to claim 1, wherein said oil pump has an aluminum body.

7. The pump according to claim 6, wherein said aluminum body is an aluminum billet body.

8. An oil pump used in combination with an engine, comprising:

a high pressure gerotor and cam chest scavenger gerotor first housing comprising a top inset and a bottom inset;

a separator plate disposed above said first housing that enables an independent passageway dual scavenging capability of said oil pump;

a crankcase sump scavenger gerotor second housing comprising a bottom inset disposed above said separator plate;

a high pressure gerotor disposed below said first housing bottom inset that pulls oil from an oil reservoir through a first separate passageway and supplies the oil from the oil reservoir under pressure through a cam plate to said engine;

a cam chest scavenger gerotor disposed in said top inset of said first housing below said separator plate capable of independently scavenging oil in a cam chest sump of said engine through a second separate passageway and returning the oil from the cam chest sump to said oil reservoir;

a crankcase sump scavenger gerotor disposed in said second housing bottom inset above said separator plate capable of independently scavenging oil in said crankcase sump of said engine through a third separate passageway and returning the oil from the crankcase sump to said oil reservoir; and an o-ring disposed beneath said high pressure gerotor to prevent oil from leaking into said cam chest of said engine, wherein said cam chest scavenger gerotor is capable of independently providing a dry cam chest sump and said crankcase sump scavenger gerotor is capable of independently providing a dry crankcase sump.

9. The pump according to claim 8, wherein said oil pump is designed as a replacement oil pump the engine.

10. The pump according to claim 8, wherein said oil pump employs shadow ports and shadow porting.

11. The pump according to claim 8, wherein said oil pump has an aluminum body.

12. The pump according to claim 11, wherein said aluminum body is an aluminum billet body.

* * * * *